US005990074A

United States Patent [19]

Gross et al.

[11] Patent Number: 5,990,074

[45] Date of Patent: Nov. 23, 1999

[54] PROCESS TO MAKE SOAP

[75] Inventors: William S. Gross, Randolph; Glen Warren Hawes, Roselle, both of N.J.

[73] Assignee: Colgate-Palmolive Co., New Yorlk, N.Y.

[21] Appl. No.: 08/823,846

[22] Filed: Mar. 25, 1997

Related U.S. Application Data

[60] Provisional application No. 60/014,243, Mar. 26, 1996.

[51] Int. Cl.[6] ..... C11D 13/00; C11D 13/04

[52] U.S. Cl. ..... 510/458; 510/141; 510/152; 510/153; 510/459

[58] Field of Search ..... 510/133, 141, 510/152, 153, 458, 459

[56] References Cited

U.S. PATENT DOCUMENTS

| | | | |
|---|---|---|---|
| 1,874,388 | 8/1932 | Travis . | |
| 3,622,516 | 11/1971 | Shen et al. | 252/109 |
| 4,387,040 | 6/1983 | Straw . | |
| 4,671,892 | 6/1987 | Bereiter . | |
| 4,758,370 | 7/1988 | Jungermann et al. . | |
| 4,789,499 | 12/1988 | Bereiter . | |

FOREIGN PATENT DOCUMENTS

| | | | |
|---|---|---|---|
| 3704605 | 8/1987 | Germany | C11D 13/04 |
| 0316935 | 10/1930 | United Kingdom . | |
| 2247464 | 3/1992 | United Kingdom | C11D 9/26 |

*Primary Examiner*—Necholus Ogden
*Attorney, Agent, or Firm*—Martin B. Barancik

[57] ABSTRACT

A process for producing soap which comprises blending soaps, water, and glycerin prepared from a. the neutralization of at least one free fatty acid with a strong alkali to produce soap and water, and b. the saponification of at least one triglyceride with a strong alkali to produce soap and glycerin, the amount of glycerin from step b being sufficient to provide up to about 6 wt. % of glycerin to the finished soap product.

A process for producing soap from a mixed feedstock of at least one triglyceride and at least one free fatty acid which comprises contacting at least one triglyceride and at least one free fatty acid with strong alkali at an elevated temperature, the quantity of triglyceride present so that the glycerine produced from its saponification with strong alkali does not exceed about 6 wt. % of the finished soap product.

11 Claims, No Drawings

PROCESS TO MAKE SOAP

This application claims the benefit of U.S. Provisional application Ser. No. 60/014,243 filed Mar. 26, 1996.

BACKGROUND OF THE INVENTION

Soaps have been utilized for years to remove soil from surfaces. Various processes have been used to produce soap. Generally, the two most preferred starting materials are triglycerides which are saponified into soap and free-fatty acids which are neutralized into soaps. Saponification of the triglyceride is usually performed in an open kettle at a temperature of from about 215–220° F. over a long period of time, several hours. Alternatively, the saponification is carried out in a continuous closed systems at super atmospheric pressure and a temperature of about 250° F. Fatty acid neutralization is usually not carried out in an open kettle because of oxidation problems. It is usually performed in a closed system at atmospheric pressure and a temperature of about 195° F.

The invention of this application allows for both saponification and neutralization to occur simultaneously at a temperature not generally achievable by saponification alone. This invention brings about significant cost savings, primarily realized from three avenues. Firstly, the price differential between the neutral oil or fat as opposed to the total use of fatty acids is substantial. Secondly, the in situ formation of glycerin negates the need to purchase glycerin and add such glycerin to soap made by neutralization alone. Thirdly, the mixed charge of triglyceride and fat allows the reaction to proceed at a lower temperature than is normally required for complete saponification of a total triglyceride feed charge. This provides for lower energy input as well as an additional cost advantage with respect to equipment purchase price since equipment rated for higher pressures and temperatures is not required.

SUMMARY OF THE INVENTION

In accordance with the invention, there is a process for producing soap which comprises blending soaps, water, and glycerin prepared from a. the neutralization of at least one free fatty acid with a strong alkali to produce soap and water, and b. the saponification of at least one triglyceride with a strong alkali to produce soap and glycerin, the amount of glycerin from step b being sufficient to provide up to about 6 wt. % of glycerin in the finished soap product.

Further in accordance with the invention there is a process for producing soap from a mixed feedstock of at least one triglyceride and at least one free fatty acid which comprises contacting at least one triglyceride and at least one free fatty acid with strong alkali at an elevated temperature, the quantity of triglyceride present in an amount so that the glycerin produced from its saponification with strong alkali does not exceed about 6 wt. % of the finished soap product.

DETAILED DESCRIPTION OF THE INVENTION

The triglyceride utilized as a portion of the feedstock in the reactor is any triglyceride normally utilized in soap making. Examples of such triglycerides include those derived from coconut oil, palm kernel oil, palm stearin oil, palm oil, tallow, tallow olein, tallow stearin, soya, hydrogenated soya, babasu oil, fish oils, and the like. The saponification reaction with strong alkali produces glycerin as well as a soap having as the long chain alkyl grouping the long chain alkyl group from the triglyceride. It is well known that the saponification reaction does not proceed rapidly and has significant problems with respect to completion, particularly when triglycerides with longer alkyl groupings, for example, having a preponderance of $C_{16}$ and $C_{18}$ chains, are employed as opposed to those triglycerides with a preponderance of $C_{12}$ and $C_{14}$ chains. Examples of long chain triglycerides are those derived from tallow and palm oil. However, in this invention no significant difference in processing conditions is observed between a tallow derived triglyceride feedstock and a coconut oil derived triglyceride feedstock. The coconut oil has a predominance of $C_{12}$ and $C_{14}$ alkyl groups therein. Generally, the alkyl grouping of the triglyceride will have significant numbers, that is a preponderance, of alkyl groups in the $C_{12}$–$C_{18}$ range. The alkyl groups are normal or branched, preferably normal.

Free fatty acids which are employed in the reaction are those normally used in soaps, i.e., having a preponderance of $C_{12}$–$C_{18}$ alkyl groups therein. The alkyl groups are normal or branched, preferably normal. Examples of such carboxylic acids includes lauric, myristic, palmitic, stearic and the like. The neutralization reaction with strong alkali is the classic neutralization of an acid with a base to form a salt (i.e. soap) and water.

The strong alkali generally employed in the reaction is generally sodium hydroxide or potassium hydroxide. However, it is preferred to use the alkali metal hydroxide, sodium hydroxide.

Generally, the contents of the reactor can include triglyceride, free fatty acid, strong alkali and water, although it is preferable to have a small amount of salt such as sodium chloride in order to control the viscosity, provide finished product traits particularly in bar form, and assist in controlling the phases present in the reactor.

The reactor which can be employed is any type of reactor used for fatty acid neutralization reactions. Generally, this is a stirred tank reactor which is preferably equipped with a high capacity recycle stream. There is generally at least a 5 to 1 recycle rate as measured by weight of recycling material to feed material. The hold-up time is usually a minimum of about 5 minutes in the reactor, preferably a minimum of about 10 or about 15 minutes. The maximum hold up time is primarily a matter of economics. Generally, hold up times of less than about 60 minutes, preferably less than about 45 minutes are employed. The temperature of the reaction is sufficient to complete the reaction. Generally, this is above about 180° F. The maximum temperature is not unduly significant, but is specifically related to the potential loss of water in an open system, if that is used. Therefore, the temperature is generally not much above about 215° F. It is preferable to maintain reaction temperatures of from about 190–210° F. The actual temperatures clearly depend upon the desired residence time, hold-up time, in the reactor. The strong alkali, preferably sodium hydroxide is preferably employed at slightly greater than the actual stoichiometric amounts. This brings about a reaction which is driven to completion and avoids the triglyceride non-saponification which can lead to rancidification in the final solid product. The excess amount of alkali, i.e., sodium hydroxide above the actual stoichiometric amount, is utilized to drive the reaction to a level of unsaponified triglyceride which can no longer be measured by conventional analytical means.

Below is a specific analytical method which can be employed for this measurement. The amount of unsaponified oils in a soap sample are indirectly measured due to the presence of other oils which are unsaponifiable. These unsaponifiable oils remain unreacted throughout the cosaponification reaction and cannot be easily separated from the unsaponified oils. The amount of unsaponified oils are determined by difference. The total of unsaponified plus unsaponifiable oils in a sample of soap, known as U+U, is measured in one analysis, and the amount of unsaponifiable oils is measured in another analysis. The difference is the amount of unsaponified oils. Due to the complexity of this analysis, which involves multiple transfers of the solutions being analyzed, there is a degree of error which cannot be overcome. From experience, if the final difference of the quantity % U+U minus the % unsaponifiable amount is in the range of about +/−0.05%, the unsaponified amount is considered to be zero.

The analytical procedure is as follows. A sample of soap, about 8 to 10 grams, to be analyzed is weighed and dissolved in 300 ml of a 1:1 by volume mixture of distilled water and denatured alcohol. The solution is made slightly acidic and may be heated to facilitate dissolving. When fully dissolved, the mixture is made alkaline with NaOH to phenolphthalein color. It is then extracted with 100 ml of a solvent mixture of pentane isomers (hexane may also be used), by shaking them together in a flask. After the solvent separates, it is removed and saved. This extraction is done three or four times depending on the efficiency of separation. The total quantity of solvent removed from the three or four extractions is combined and washed three times with 10 to 15 ml of denatured alcohol each time to remove any fatty acids which may have been extracted. The washed pentane solvent is transferred to a tared flask and completely distilled off. The residual free oil left in the flask after distilling off the solvent is quantified by weighing to four-place accuracy on an analytical balance. It is then expressed as a percent of the starting weight of soap. This percent is the total amount of unsaponified and unsaponifiable oils, U+U.

To determine the amount of unsaponified oil, the amount of unsaponifiable oil is measured and subtracted from the total of U+U. The amount of unsaponifiable oil is measured by heating and reacting the sample in a strong caustic environment for about 20 minutes to fully saponify any unsaponified oils first. The sample will then contain only unsaponifiable oils and is analyzed by pentane extraction as described above to determine the amount of unsaponifiable oils present. This analysis may be done on the same sample for which the U+U was determined, by redissolving the residual oil in a 1:1 water and alcohol mixture and reacting it prior to re-extraction, or a fresh sample of the same soap may be used.

For the invention process, in practice, the excess caustic concentration can amount to about 0.05 wt. % of the total reaction mass above the actual stoichiometric amount calculated for the reaction feed materials. Preferably, it is about 0.1 wt. % or higher. The major factor for determining the maximum amount of alkali coverage is primarily dependent upon the cost of the material. However, large amounts of alkali overage can begin to affect the final pH of the soap product as well. Therefore, no more than about 0.2 wt. % alkali excess is generally employed.

As noted previously, this particular invention process results in the presence of glycerin in the final soap product, such glycerin prepared in situ during the triglyceride saponification. Because of various handling problems as well as undesired plasticity, it is usual to not have more than about 6 wt. % glycerin in the final product. A 6 wt. % glycerin content will generally bring about a relatively translucent and plastic bar. Generally, no more than about 2.5 wt. % glycerin is desirable, preferably no more than about 2 wt. %. Assuming that all the glycerin comes from the triglyceride saponification, the wt. % of triglyceride present in the reactor is specifically related to the amount of glycerin that one wishes to have in the final soap product. The quantity of triglyceride can differ due to the quantity of glycerin present in the particular triglyceride. For example, a coconut oil based triglyceride has about 14 wt. % glycerine in the triglyceride while a tallow based triglyceride has about 10 wt. % glycerine in the triglyceride. Generally, about 18 to about 25 wt. % of the charge of triglyceride and free fatty acid is triglyceride. The specific quantity of triglyceride employed is dependent upon the quantity of glycerin desired in the final product and the source of the triglyceride. A shaped solid product such as a hand-held bar is most preferred.

The reaction can proceed in either a batch or continuous manner. The temperatures are such that an open system can be employed, particularly in the batch procedure. However, for a continuous process, it is generally preferred to have some pressure on the system, at least to bring about the circulation of the materials within a closed loop. The pressures which can be employed can vary from about 5 psig to whatever pressure is desired. Generally, pressures of less than about 100 psig can be employed. Pressure is generally not a significant variable in this process. Exact pressures are determined by the design of the equipment, particularly the pumps. Clearly, mixing is of some significance so as to provide at least minimum contact of the reactants. A steady, essentially isothermal temperature controlled reaction is desirable and readily obtained.

As noted, it is preferable to do the reaction in one reactor. However, if one wishes to, one can run each one of the reactions, i.e., the saponification and neutralization reactions, each in a separate reactor or sequentially in the reactor and combine the products thereafter to form the same composition as would be formed in the preferred method of reaction in a single reactor.

Below are examples of the invention. These examples are not intended to narrow the invention, but are used to exemplify the broad nature and scope of the invention. All the analyses for unsaponified oil are conducted by the method previously described in the specification.

EXAMPLE 1

A stainless steel reactor system composed of a centrifugal pump in a recycle loop with a heat exchanger and a flow-through holding vessel is used to produce a cosaponified soap product from refined, bleached, and deodorized palm kernel oil and a fatty acid blend of tallow and coconut fatty acids. The reaction is carried out in a continuous fashion with three accurately weight-metered feed streams being continuously fed: the fatty acid blend, the refined, bleached, and deodorized palm kernel oil, and a lye, which is an aqueous solution of sodium hydroxide and sodium chloride. These three streams are fed into the inlet of the centrifugal pump along with the returning bulk recycle stream to provide for good mixing of the feed ingredients. After a start-up period to bring the reactor system to steady state, the soap product is continuously drawn out of the recycle loop through a back-pressure valve. The temperature of the reactor is maintained by the heat of reaction and controlled by tempered cooling water in the recycle loop heat exchanger. The total quantity of soap held up as it is recycling in the reactor system is 25 lbs.

The fatty acid blend of 74.2% tallow fatty acid and 25.8% coconut fatty acid, having an acid value of 223.5 gm KOH/kg fatty acid, is fed at a rate of 20.8 lbs/hr; the refined, bleached, and deodorized palm kernel oil, having a saponification value of 251 gm KOH/kg oil, is fed at a rate of 5.17 lbs/hr; and the lye, with concentrations of 26.6% sodium hydroxide and 1.56% sodium chloride, is fed at a rate of 15.9 lbs/hr. These rates and concentrations provide an average reaction residence time of 35.8 minutes and the stoichiometric proportions necessary to neutralize the fatty acids, to saponify completely the refined, bleached, and deodorized palm kernel oil, to leave a residual concentration of sodium hydroxide of 0.1% in the soap product, and to produce a soap product having a 60/40 tallow/coco fatty acid ratio with 1.7% glycerin (about 2.0% glycerin in the final soap bar product after addition of finishing ingredients and drying to 10% moisture), 0.6% sodium chloride, and 30.7% water. The reaction is carried out at a temperature of 200° F., with a system pressure of 35 to 45 psig at the inlet and 60 to 70 psig at the outlet of the centrifugal pump. Five samples of the final product were analyzed to contain 0.0 to 0.015% unsaponified free neutral oil.

EXAMPLE 2

A process is run as described in Example 1, but where the residence time of the reactor system is 15 minutes, the temperature is in the range of 195 to 205° F., and the residual sodium hydroxide is in the range of 0.1 to 0.2%. The feed materials and flow rates are as follows. The fatty acid blend of 72.6% tallow fatty acid and 27.4% coconut fatty acid, having an acid value of 222.4 gm KOH/kg fatty acid, is fed at a rate of 49.98 lbs/hr; the refined, bleached, and deodorized palm kernel oil, having a saponification value of 248.8 gm KOH/kg oil, is fed at a rate of 11.03 lbs/hr; and the lye, with concentrations of 25.27% sodium hydroxide and 1.58% sodium chloride, is fed at a rate of 38.2 to 38.6 lbs/hr. These rates and concentrations provide an average reaction residence time of 15 minutes and the stoichiometric proportions necessary to neutralize the fatty acids, to saponify completely the refined, bleached, and deodorized palm kernel oil, to leave residual concentrations of sodium hydroxide of 0.1% and 0.2% in the soap product, and to produce a soap product having a 60/40 tallow/coco fatty acid ratio with 1.5% glycerin (about 2.0% glycerin in the final soap bar product after addition of finishing ingredients and drying to 10% moisture), 0.6% sodium chloride, and 31.6% water. The reaction is carried out at temperatures of 195° F. and 205° F. for both levels of residual sodium hydroxide, with a system pressure of 35 to 45 psig at the inlet and 60 to 70 psig at the outlet of the centrifugal pump. Samples of the final product were analyzed to contain 0.01% to 0.05% unsaponified free neutral oil.

EXAMPLE 3

A process is run as described in Example 1, but with the neutral oil being refined, bleached, and deodorized coconut oil. The feed materials and flow rates are as follows. The fatty acid blend of 74% tallow fatty acid and 26% coconut fatty acid, having an acid value of 228.4 gm KOH/kg fatty acid, is fed at a rate of 20.35 lbs/hr; the refined, bleached, and deodorized coconut oil, having a saponification value of 253 gm KOH/kg oil, is fed at a rate of 5.02 lbs/hr; and the lye, with concentrations of 26.16% sodium hydroxide and 1.53% sodium chloride, is fed at a rate of 15.78 lbs/hr. These rates and concentrations provide an average reaction residence time of 36.45 minutes and the stoichiometric proportions necessary to neutralize the fatty acids, to saponify completely the refined, bleached, and deodorized coconut oil, to leave a residual concentration of sodium hydroxide of 0.1% in the soap product, and to produce a soap product having a 60/40 tallow/coco fatty acid ratio with 1.69% glycerin (about 2.0% glycerin in the final soap bar product after addition of finishing ingredients and drying to 10% moisture), 0.6% sodium chloride, and 31.2% water. The reaction is carried out at a temperature of 200° F., with a system pressure of 35 to 45 psig at the inlet and 55 to 65 psig at the outlet of the centrifugal pump. Samples of the final product were analyzed to contain 0.0% to 0.04% unsaponified oil.

EXAMPLE 4

A process is run as described in Example 1, but with edible tallow being substituted for the refined, bleached, and deodorized palm kernel oil. The feed materials and flow rates are as follows. The fatty acid blend of 47.3% tallow fatty acid and 52.7% coconut fatty acid, having an acid value of 238.9 gm KOH/kg fatty acid, is fed at a rate of 19.25 lbs/hr; the edible tallow, having a saponification value of 196.2 gm KOH/kg tallow, is fed at a rate of 6.41 lbs/hr; and the lye, with concentrations of 26.86% sodium hydroxide and 1.56% sodium chloride, is fed at a rate of 15.68 lbs/hr. These rates and concentrations provide an average reaction residence time of 36.28 minutes and the stoichiometric proportions necessary to neutralize the fatty acids, to saponify completely the edible tallow, to leave a residual concentration of sodium hydroxide of 0.12% in the soap product, and to produce a soap product having a 60/40 tallow/coco fatty acid ratio with 1.66% glycerin (about 2.0% glycerin in the final soap bar product after addition of finishing ingredients and drying to 10% moisture), 0.6% sodium chloride, and 31.2% water. The reaction is carried out at a temperature of 200° F., with a system pressure of 30 to 45 psig at the inlet and 60 to 70 psig at the outlet of the centrifugal pump. Samples of the final product were analyzed to contain 0.0% unsaponified tallow.

All of the specific examples relate to preparation of a solid soap product, the preferred bar. However, the process is also applicable to liquid soap products as well.

What is claimed is:

1. A continuous process for producing soap from a mixed feedstock of at least one triglyceride and at least one free fatty acid which comprises contacting at least one triglyceride and at least one free fatty acid with strong alkali at an elevated temperature, the quantity of triglyceride present so that the glycerine produced from its saponification with strong alkali does not exceed about 6 wt. % of the finished soap product said process having a high capacity recycle stream, and wherein the finished soap product is a bar.

2. The process in accordance with claim 1 wherein the temperature is from about 180° to about 215° F.

3. The process in accordance with claim 1 wherein the temperature is sufficient to bring about a hold up time of at least about 5 minutes.

4. The process in accordance with claim 3 wherein the hold up time is at least about 10 minutes.

5. The process in accordance with claim 1 wherein there is sufficient excess alkali present so that at the end of the process the amount of unsaponified triglyceride can no longer be measured.

6. The process in accordance with claim 2 wherein there is sufficient excess alkali present so that at the end of the process the amount of unsaponified triglyceride can no longer be measured.

7. The process in accordance with claim 1 wherein the triglyceride has a higher weight percentage of alkyl groups having at least sixteen carbon atoms than the triglyceride has below sixteen carbon atoms.

8. The process in accordance with claim 7 wherein the triglyceride is derived from tallow.

9. The process in accordance with claim 1 wherein the glycerin present in the finished soap bar is not above about 2.5 wt. %.

10. The process in accordance with claim 1 wherein the hold-up time is at least about 10 minutes, a high capacity recycle stream is present in the process, and there is less than about 2.5 wt % glycerine in the soap product.

11. The composition in accordance with claim 1 wherein the charge triglyceride and free fatty acid is about 18 to about 25 wt % of triglyceride.

* * * * *